United States Patent [19]

Brown

[11] 4,389,549

[45] Jun. 21, 1983

[54] SIDE ACTUATED MINIATURE DIP SWITCH

[75] Inventor: Richard P. Brown, Paso Robles, Calif.

[73] Assignee: CTS Corporation, Elkhart, Ind.

[21] Appl. No.: 323,919

[22] Filed: Nov. 23, 1981

[51] Int. Cl.[3] ..... H01H 19/04

[52] U.S. Cl. ..... 200/5 R; 200/6 B; 200/6 BB; 200/339

[58] Field of Search ..... 200/6 R, 6 A, 6 B, 6 BA, 200/6 BB, 6 C, 153 H, 153 J, 335, 339, 67 G, 153 L, 153 LB, 5 R

[56] References Cited

U.S. PATENT DOCUMENTS

| | | | |
|---|---|---|---|
| 2,975,250 | 3/1961 | Long et al. | 200/67 |
| 3,408,463 | 10/1968 | Wanlass | 200/6 |
| 3,740,448 | 6/1973 | Olszowka et al. | 84/1.01 |
| 3,878,344 | 4/1975 | Lockard | 200/6 R |
| 3,879,592 | 4/1975 | Comerford et al. | 200/153 G |
| 3,978,298 | 8/1976 | Fukuda et al. | 200/6 R |
| 4,119,823 | 10/1978 | Matsueda et al. | 200/6 R X |
| 4,173,166 | 11/1979 | Koepke | 84/343 |
| 4,176,261 | 11/1979 | Epple | 200/1 V |

*Primary Examiner*—R. L. Moses
*Assistant Examiner*—Morris Ginsburg
*Attorney, Agent, or Firm*—Larry J. Palguta; John A. Young

[57] ABSTRACT

A miniature DIP switch (10) has actuator levers (82) projecting from a side of the housing (12). A plurality of cantilevered moveable contact arms (72) are supported by a section (34) of the base (30), and a plurality of oppositely disposed cantilevered contact arms (62) are supported by a complementary section (32) of the base. A plurality of insulative rotatable lever actuators (80) are supported each by a respective moveable contact arm (72). Each actuator (80) comprises a lever (82) projecting from a respective opening (18) In the housing (12), an arcuate bearing surface (86) engaging an arcuately shaped boss (22) in the housing, a pair of depending side walls (88) each having arcuately shaped ends (90), and a cam protrusion (87) disposed between the depending side walls (88) and engaging its respective moveable contact arm (72). Rotation of the actuator (80) about the arcuately shaped boss (22) causes slideable engagement of the cam protrusion (87) with the moveable contact arm (72) whereby the moveable contact arm (72) is biased into engagement with its respective contact arm (62). A detent notch (77) in each moveable contact arm (72) provides a positive detent "feel" and "snap" upon engagement of the cam protrusion (87) with the notch (77).

13 Claims, 5 Drawing Figures

SIDE ACTUATED MINIATURE DIP SWITCH

DESCRIPTION

1. Technical Field

This invention relates to a miniature DIP (dual in-line package) switch employing side actuated levers.

2. Background Art

Switches employing a rocker type actuator or side operated lever actuator typically utilize annular shafts extending from the sides of the actuator and fittable within a complementary shaped housing wall for rotation of the actuator. Garcia U.S. Pat. No. 4,031,345 entitled "Miniature Electrical Switch," issued June 21, 1977 illustrates a typical construction of this type wherein the shafts extend from each side of the actuator and fit within complementary shaped notches in housing walls. Another typical approach for effecting the rotatable positioning of the actuator, is to mount the actuator upon a pivot pin disposed longitudinally in the housing. Brown U.S. Pat. No. 4,022,999 issued May 10, 1977 and entitled "Plural-Circuit Progressive Switch," illustrates a rocker contactor switch having a pivot pin supported by stanchions, the pivot pin extending through the actuator to rotatably mount the actuator thereabout.

Each of these constructions has as its object the rotatable mounting of an actuator within the housing, and each construction utilizes a multiplicity of parts in order to effect this type of mounting.

As the need for a variety of smaller DIP (dual in-line package) switches increases, there is a need for a switch of a simple design having rotatable actuators and utilizing a minimum of parts. As the size of the switch decreases, it becomes increasingly difficult to manufacture a switch having a multiplicity of parts and assemble the parts. Additionally, there is a need for a miniature DIP switch having rotatable, side-actuated levers, that is, having lever arms extending from the side of the switch so that each individual switch in the switch package may be opened and closed by movement of a lever extending from the side of the switch housing.

As the size of DIP switches has decreased with miniaturization of the package and components therein, various designs have been utilized to reduce the number of parts and yet produce a reliable switch construction. Shown in FIG. 1 of the drawings and labeled "prior art" is a side actuated DIP switch provided by AMP, Inc. of Harrisburg, Pennsylvania. This side-actuated DIP switch includes an actuator having a pivot pin engaging the ceiling of the housing and two depending protrusions for effecting engagement of the contact arms. Upon downward movement of the actuator lever, the actuator pivots about the pin and biases the arcuately shaped contact arm into engagement with the other contact arm which is allowed to rise as the left protrusion is displaced upwardly. As the lever is moved downwardly, the entire actuator may move downwardly because the pivot pin is not fixed in position and the actuator is not positioned for contact with the interior base of the housing. Therefore, it would be desirable to provide a side actuated miniature DIP switch wherein the actuator does not move downwardly upon rotation of the actuator so as to deform the metal contacts, and to accomplish this by providing an actuator that can engage the interior base of the housing.

Other DIP switch constructions have utilized the design approach wherein both contact arms are cantilevered within the housing, by embedding the contact arms within the base. Zdanys U.S. Pat. No. 3,944,760 entitled "Switch Assembly Having Slider Actuator Insulating Plate Inserted Between Normally Closed Contacts," issued Mar. 16, 1976 and assigned to the same assignee, illustrates a DIP switch having cantilevered contact arms located within a housing. Each of the contact arms biases the actuator into engagement with the top wall of the housing. It is desirable to provide a miniature DIP switch having cantilevered contact arms wherein one of the cantilevered contact arms is of shorter length and mounted at a lower level and is thereby less flexible and more reliably positioned within the housing, the other contact arm being positioned over the shorter contact arm. Completion of an electrical circuit across the contact arms would be effected by biasing the longer contact arm downwardly into engagement with the underlying flexible contact arm. This construction results in little if any movement of the less flexible contact arms, which increases the reliability of the switch over its wear life because only one of the arms is moved, and thereby reducing the number of parts which must be moved to effect operation of the switch.

DISCLOSURE OF THE INVENTION

The present invention comprises a side-actuated miniature DIP switch having a housing mounted on two base sections secured together, each base section having a plurality of cantilevered contactors embedded therein. Each contactor embedded in the first base section has an integral terminal portion extending from the bottom of the base section, an arm projecting parallel to the top of the base, and a contact element located near the free end of the contact arm. The second base section has a plurality of flexible or moveable cantilevered contact arms, each moveable contact arm having an integral terminal extending from the bottom of the second base section, and the moveable contact arm angled substantially perpendicular to the terminal portion to extend inwardly and parallel to the top of the second base section. Each moveable contact arm overlies its complementary rigid contact arm. Fitted over the base is a housing having a slanted side wall with a plurality of openings therein. Adjacent each opening and within the interior of the housing, are a plurality of transverse walls. Extending longitudinally along the top of said housing and forming one end of each opening, is an arcuately shaped boss. A plurality of rotatable lever actuators is disposed within the housing. Each actuator comprises a lever arm projecting through its respective housing opening, an arcuate bearing surface complementarily engaging the arcuately shaped boss of the housing, depending side walls terminating in arcuately shaped ends, and a cam projection between the side walls and integral with the actuator. Each actuator is supported by a moveable contact arm which biases the arcuate bearing surface into engagement with the arcuate shaped boss, and the cam protrusion engages the moveable contact arm. Depression of the lever actuator effects slideable engagement between both the arcuate bearing surface and the boss, and the cam protrusion and the moveable contact arm. The cam protrusion biases the moveable contact arm into engagement with the contact element of its respective contact arm, and engages a detent notch in the moveable contact arm. The detent notch provides a detent so that the user feels a positive snap engagement of the cam protrusion and moveable contact arm, and retains the switch in the "on" position until the lever is moved upwardly.

BEST MODE FOR CARRYING OUT THE INVENTION

Figure 1:
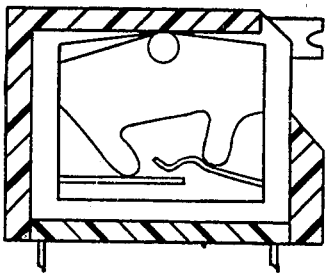
PRIOR ART FIGURE 1
FIG. 1 illustrates a prior art construction.
Figure 2:
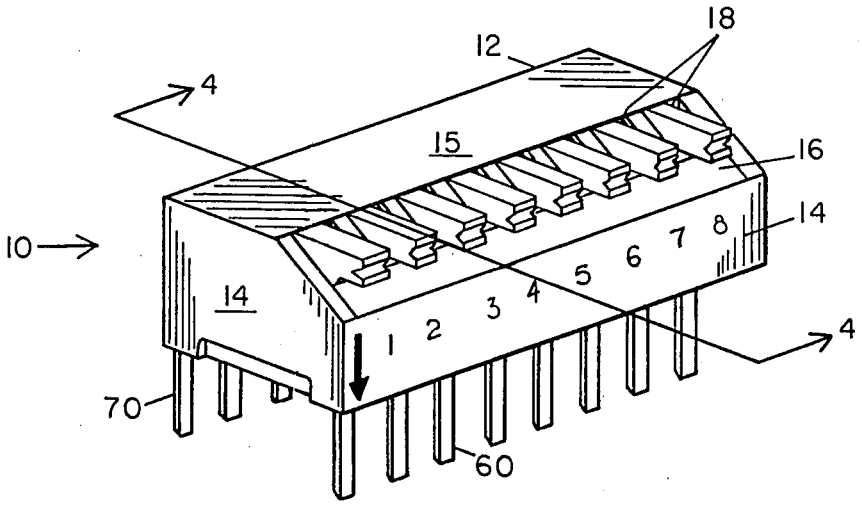
FIG. 2 is an isometric view of the switch of the present invention.
Figure 3:
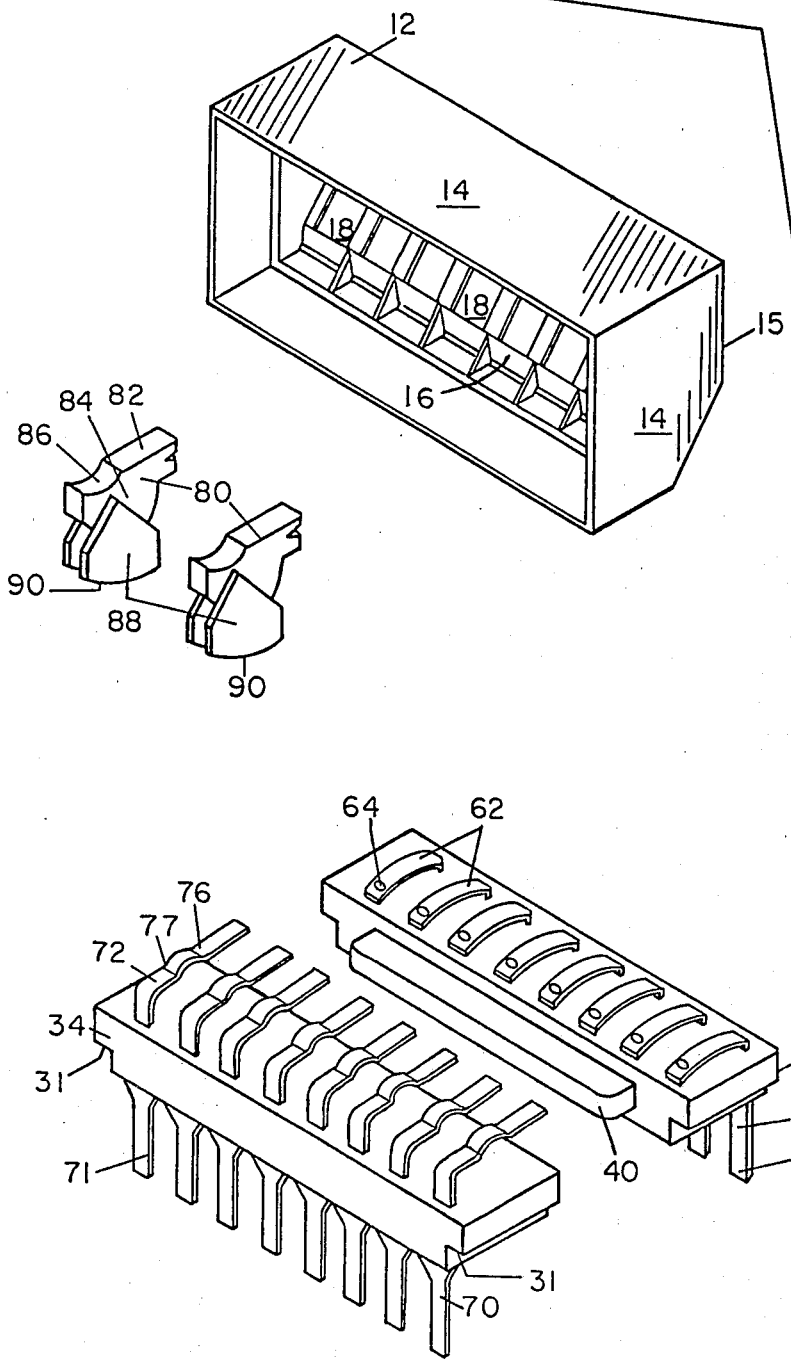
FIG. 3 is an exploded view of the assembly shown in FIG. 2.

Referring now the the drawings, and particularly FIGS. 2 and 3, the side-actuated miniature DIP switch is designated generally by reference numeral 10. The switch 10 comprises a housing 12 disposed over a base 30. Housing 12 consists of side walls 14, top wall 15, and slant wall 16 having a plurality of longitudinally aligned openings 18 located adjacent a longitudinal and arcuate shaped boss 22. Located within the housing 12 is a plurality of transverse walls 20, each wall located between adjacent openings 18 in slant wall 16 and extending laterally away from boss 22 and slant wall 16. The base 30 is comprised of a first section 32 and a second section 34, the first section 32 having an elongated key 40 and the second section 34 having an elongated key way 42. The elongated key 40 interfits with the elongated key way 42 to secure the first and second base sections together and provide the base 30 with a top surface 50. The first base section 32 has a plurality of first contacts 60 embedded therein, and the second section 34 has a plurality of second contacts 70 embedded therein. The contacts 60, 70 have terminals 61, 71, respectively, integral therewith which extend from the bottom of the respective base sections, and the upper portion of the contacts are angled to extend substantially parallel to the top surface 50 of the base 30. Preferably, portions of a blanked strip of metal are embedded in each base section at the time of molding, the blanked metal strip then being punched and formed to provide the first and second contacts.

Each of the first contacts 60 and second contacts 70 are preferably of gold plated brass sheet. The first contacts comprise cantilevered contact arms 62 bent to extend substantially parallel to the base surface 50, each having a contact element 64 thereon. The second contacts 70 are also bent substantially perpendicular to the base section 30 and extend substantially parallel to the base surface 50. However, the contacts 70 comprise moveable contact arms 72 substantially longer in length than contact arms 62. Each moveable contact arm 72 overlies its oppositely disposed and associated contact arm 62. The moveable contact arm 72 includes a set of arcuately shaped notches 76, 77 for a purpose to be hereinafter explained. Because the length of each of the moveable contact arms 72 is longer than the length of a contact arm 62, the moveable contact arms 72 are considerably more flexible than the contact arms 62. The shorter contact arms 62, although mounted in cantilevered fashion above the surface 50, have much less flexibility and are more rigidly positioned.

In accordance with the present invention, engaging each moveable contact arm is a insulative rotatable lever actuator 80. Each rotatable lever actuator 80 comprises a lever 82, an actuator body 84 having at one end thereof an arcuate bearing surface 86, and a pair of depending side walls 88 terminating in arcuately shaped ends 90. Disposed between the depending side walls 88 and integral with body 84 is a cam protrusion 87 (see FIGS. 4 and 5). The body 84, cam projection 87, and depending side walls 88 form an opening therebetween in which is situated a moveable contact arm 72. When the actuator 80 is rotatably mounted about boss 22, it engages a moveable contact arm 72 and the contact arm is biased downwardly as the housing is fitted over the base 30.

Each actuator 80 fits within its respective actuator opening 18 of the housing 12. The lever 82 extends through the respective opening 18 and projects outwardly from the slant wall 16 and arcuate bearing surface 86 engages the arcuate shaped boss 22 of the housing 12. Each actuator 80 is biased upwardly against the boss 22 by the associated moveable contact arm 72. The housing 12 fits over the first and second base sections, 32 and 34, and is secured to the base sections by heat staking the ends of the housing thereunder.

From the foregoing description, it is apparent that the side actuated miniature DIP switch can be easily assembled. A blanked metal strip has suitable slots, and base sections are molded integral with the blank strip thereby embedding portions of the blanked strip in the base sections. The strip is then punched and formed to provide the moveable contact arms 72 or contact arms 62. The complementary base sections 32, 34 are joined to align the moveable contact arms 72 with the respective contact arms 62. Rotatable lever actuators 80 are placed in their respective openings 18 with each arcuate bearing surface 86 engaging the arcuate shaped boss 22 and the levers 82 extending from the openings 18. The housing 12 and actuator 80 are positioned over the base 30 so that the walls 88 of each actuator 80 receive the respective moveable contact arm 72 therebetween. The housing 12 is secured to the base 30 by heat staking a portion of the ends 14 over the base shoulders 31 (see FIGS. 2 and 3).

OPERATION

Figure 4:
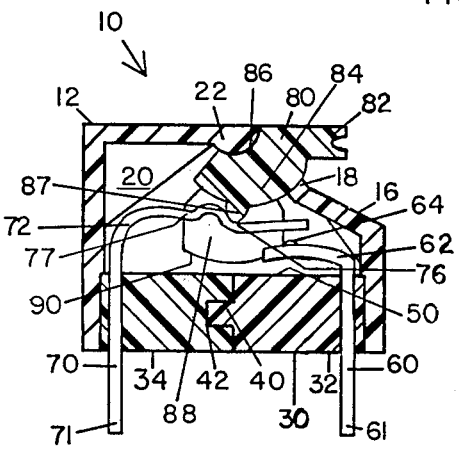
FIG. 4 is a sectional view taken along view lines 4—4 of FIG. 2
Figure 5:
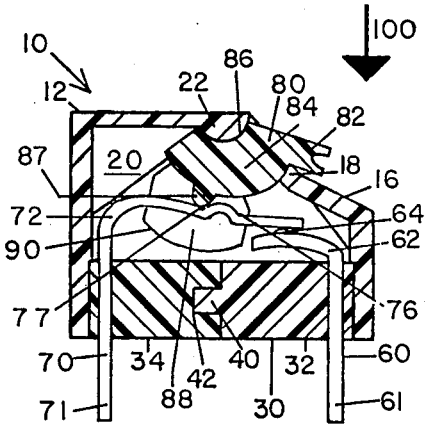
FIG. 5 illustrates the closed position of the switch.

The assembled side actuated miniature DIP switch 10 is operated by depressing lever 82 downwardly to effect engagement of the moveable contact arm 72 with its associated contact arm 62. Referring to FIG. 4, the switch 10 is shown in an open or "off" mode wherein the top of the lever 82 is flush with the top surface of the housing and the lever projects outwardly from the slant wall 16. In this position, the detent protrusion 87 engages detent notch 76, and the moveable contact arm 72 is spaced from the contact arm 62. Upon depression of the lever 82 as shown by the arrow 100 in FIG. 5, the actuator 80 rotates about the arcuately shaped boss 22, with the cam protrusion 87 sliding along the upper surface of the moveable contact arm 72. During rotation about boss 22, the cam protrusion 87 is moved to engagement with detent notch 77, and the moveable contact arm 72 is biased downwardly by the cam protrusion 87 into engagement with the contact element 64 of the respective contact arm 62. The detent notch 77 provides the user with a positive "feel" and "snap" as the cam protrusion 87 engages the notch 77, indicating that the switch is in the "on" position. The notch 77 will maintain the switch in the "on" position such that the lever will not move upwardly and disengage the moveable contact arm 72 from the contact arm 62 until the lever is forcibly moved upwardly. Thus, the switch remains in either the "on" or "off" position because the movement of cam protrusion 87 between notches 76, 77 is an overcenter movement.

The moveable contact arm 72 wipably engages the contact element 64 which insures cleaning of the contact surfaces of the contact arms 62 and 72. Because each contact arm 62 is very short in length as compared to its respective moveable contact arm 72, the contact arms are relatively fixed and inflexible so that their position will remain unchanged throughout the useable life of the switch. Thus, the moveable contact arms 72, which are considerably longer in length than contact arms 62, are the only conductive switch parts that move during operation of the switch. This effects a positive wiping engagement of a moveable contact with a contact element of a relatively fixed conductive contact arm.

The moveable contact arms 72 are cantilevered so that the spring loading of an actuator onto an arm is sufficient to maintain engagement of the bearing surface 86 with the boss 22 during operation of the switch. The arcuately shaped ends 90 can slideably engage the base surface 50 upon excessive downward movement of the actuator 80, thereby preventing any intermittent contact or possible bending or deformation of the moveable contact arm.

Industrial Applicability

The switch of the present invention may be utilized for printed circuit board switching applications.

Conclusion

Although the present invention has been illustrated and described in connection with selected example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A miniature DIP switch comprising a housing having a plurality of walls and a base defining a cavity and an arcuately shaped boss disposed within said cavity, electrically conductive movable contact arms disposed within the cavity and providing first contacts, first terminals each integral with a respective movable contact arm and supported by the housing, stationary contact arms disposed within the cavity, second terminals each integral with an end of a stationary contact arm and supported by the housing, said electrically conductive movable contact arms and stationary contact arms in respective aligned sets and in spaced apart relationship, and insulative rotatable lever actuators each having an arcuate bearing surface engaging the arcuately shaped boss, bearing means, and cam means, each actuator being interposed between a respective movable contact arm and the boss whereby said bearing means is disposed adjacent the base and said cam means engages said respective movable contact arm so that rotation of said actuator about the arcuately shaped boss biases said respective movable contact arm into wipable engagement or disengagement with its aligned stationary contact arm.

2. The switch in accordance with claim 1, wherein the bearing means of each actuator comprises first and second depending side walls and the cam means disposed between the side walls, the side walls and cam means comprising an opening, the respective movable contact arm disposed within the opening and supporting the actuator to bias said arcuate bearing surface against said arcuately shaped boss.

3. The switch in accordance with claim 2, wherein said first and second terminals extend through the base, and said stationary contact arms and electrically conductive movable contact arms are suspended above the base and between the side walls.

4. The switch in accordance with claim 1, wherein the base comprises a first section and a second section; the first terminals embedded in the first section and the second terminals embedded in the second section, the first section being joined to the second section, whereby each stationary contact arm is aligned with a corresponding movable contact arm.

5. The switch in accordance with claim 4, wherein each electrically conductive movable contact arm overlies its respective stationary contact arm, and the respective cam means slidably engages the movable contact arm during rotation of said actuator about said arcuately shaped boss whereby said movable contact arm is displaced relative to said aligned stationary contact arm.

6. In a side actuated miniature DIP switch, the combination of a first base section, a plurality of electrically conductive movable contact arms embedded in the first base section and each arm having detent means, a second base section, a plurality of electrically conductive contact elements embedded in the second base section, means interlocking the first and second base sections together and aligning each of the movable contact arms in overlapping relationship with a corresponding one of the contact elements for wipable engagement therewith, a housing secured to the first and second base sections and having an arcuately shaped boss, and a plurality of actuators mounted in the housing and operable exteriorly of the housing, each of the actuators comprising an insulative rotatable lever extending from the housing, an arcuate bearing surface engaging said arcuately shaped boss, bearing means disposed closely adjacent said base sections, and cam means engaging the detent means of its respective movable contact arm, whereby upon a predetermined rotatable movement of an actuator the respective cam means effects a predetermined relationship between a respective movable contact arm and contact element aligned therewith.

7. The switch in accordance with claim 6, wherein the detent means of each movable contact arm includes a detent notch whereby the rotation of said actuator about the arcuately shaped boss effects engagement of said cam means with said detent notch to provide a detent therebetween.

8. In a side actuated switch, the combination of a cover having a plurality of side walls including a sloped wall provided with a slot and an arcuately shaped boss, first and second base sections secured to the cover, the walls of the cover and the base sections defining a cavity, a flexible electrically conductive support means cantilevered within the cavity, a first intermediate member extending perpendicular from one end of the support means and embedded in the first base section, a terminal integral with the first intermediate member, a contact arm disposed within the cavity, a contact element integral with one end of the contact arm, a second intermediate member extending perpendicular from the other end of the contact arm and embedded in the second base section, a terminal integral with the second intermediate member, an insulative rotatable lever actuator having a pair of side walls, an operating lever integral with the actuator, an arcuate bearing surface, and a cam, the arcuate bearing surface engaging said arcuately shaped boss and the cam engaging said support means, said cam and side walls of the actuator defining an opening, the support means being disposed within the opening, said support means being moveable with respect to the contact arm whereby rotation of the actuator about the arcuately shaped boss biases the support means into contact with said contact element.

9. The switch in accordance with claim 8, further comprising a detent comprised of a notch disposed in said support means whereby upon said rotation, the cam slideably engages said support means and engages said detent notch.

10. A miniature DIP switch comprising a housing provided with an arcuately shaped boss and a plurality of walls defining a cavity, a plurality of conductive flexible support means disposed within the housing, a plurality of first terminals integral with the flexible support means and supported by the housing, a plurality of contacts disposed within said cavity, each of said contacts being in alignment with one of the support means for wipable contact therewith, a plurality of second terminals integral with the contacts and supported by the housing, a plurality of insulative rotatable lever actuators mounted in the housing, each actuator having an arcuate bearing surface engaging said arcuately shaped boss and the actuator supported by one of the support means for rotatable movement relative to said arcuately shaped boss, bearing means disposed opposite said arcuate bearing surface and adjacent a wall for engagement therewith, and actuation means of each actuator engaging its respective support means for moving the respective support means from a first to a second position.

11. The switch in accordance with claim 10, wherein the plurality of contacts are disposed in a line within the cavity, the plurality of support means are disposed in a line within the cavity, each of the support means in electrical engagement or disengagement with the respective contact, the respective actuation means engaging the respective support means in both positions.

12. The switch in accordance with claim 10, wherein the walls include a base, the first terminals are aligned and secured to the base, the second terminals are aligned and secured to the base in opposing relationship to the first terminals, the bearing means comprising a pair of spaced apart side walls integral with the respective actuator, the respective actuation means being disposed between the side walls, and the actuators aligned side-by-side longitudinally with respect to the housing.

13. A process for controlling multiple electric circuits by means of a miniature DIP switch, comprising the steps of: (a) disposing a first series of cantilevered control arms within a switch body, (b) disposing a second series of cantilevered control arms each in complementary relationship with one of said first cantilevered control arms, (c) mounting rotatable arcuate bearing seats of a plurality of actuator means about complementary shaped arcuate bearing surfaces, (d) maintaining said arcuate bearing seats in engagement with said bearing surfaces and positioning bearing means of each actuator means adjacent a base wall by resiliently loading each of said plurality of actuator means upon respective ones of said first series of cantilevered control arms, (e) engaging selected ones of said first series of cantilevered control arms with said second series of cantilevered control arms by rotating selected bearing seats about their associated bearing surfaces to selectively bias arms of said first series into wipable contact with respective arms of said second series, and (f) providing to the switch user a positive feel upon engaging selected ones of said first cantilevered control arms with their associated second cantilevered control arms by providing detent means engaging each of said actuator means.

* * * * *